US007121707B2

(12) United States Patent
Currie et al.

(10) Patent No.: US 7,121,707 B2
(45) Date of Patent: Oct. 17, 2006

(54) ILLUMINATED ELECTRICAL CORDS AND OUTLETS

(75) Inventors: Robert M. Currie, Dollard-des-Ormeaux (CA); Jonas J. Robertson, Harvey, LA (US)

(73) Assignee: Plastic Inventions and Patents, Inc., Saint Laurent (CA)

( * ) Notice: Subject to any disclaimer, the term of this patent is extended or adjusted under 35 U.S.C. 154(b) by 41 days.

(21) Appl. No.: 10/948,186

(22) Filed: Sep. 24, 2004

(65) Prior Publication Data

US 2005/0124209 A1 Jun. 9, 2005

(51) Int. Cl.
*F21V 23/00* (2006.01)

(52) U.S. Cl. ..... 362/555; 362/800; 362/640; 362/311

(58) Field of Classification Search ..... 362/511, 362/640, 235, 278, 311, 362, 555, 551, 800; 174/74 R; 385/101; 439/489, 490, 910, 439/106

See application file for complete search history.

(56) References Cited

U.S. PATENT DOCUMENTS

| | | | | |
|---|---|---|---|---|
| 3,757,102 | A | 9/1973 | Roberts | |
| 3,942,859 | A | 3/1976 | Kirodi | |
| 3,995,152 | A | 11/1976 | Chao | |
| 4,118,690 | A | 10/1978 | Paynton | |
| 4,597,033 | A | 6/1986 | Meggs | |
| 4,671,597 | A | 6/1987 | Grill | |
| 4,984,999 | A | 1/1991 | Leake | |
| 5,007,857 | A | 4/1991 | Wright | |
| 5,051,733 | A | 9/1991 | Neuhouser | |
| 5,065,142 | A | 11/1991 | Green | |
| 5,207,594 | A | 5/1993 | Olsen | |
| 5,277,620 | A * | 1/1994 | Taylor | 439/490 |
| 5,283,429 | A | 2/1994 | Campolo | |
| 5,470,252 | A | 11/1995 | Fladung | |
| 5,602,948 | A | 2/1997 | Currie | |
| 5,721,934 | A * | 2/1998 | Scheurich | 713/320 |
| 5,838,860 | A | 11/1998 | Kingstone | |
| 5,964,616 | A | 10/1999 | Eisenbraun | |
| 6,159,037 | A | 12/2000 | Madsden | |
| 6,319,051 | B1 | 11/2001 | Chang | |
| 6,336,825 | B1 | 1/2002 | Seefried | |
| 2003/0123825 | A1 * | 7/2003 | Sanso | 385/117 |
| 2004/0233668 | A1 * | 11/2004 | Telfer et al. | 362/252 |

* cited by examiner

*Primary Examiner*—Sharon Payne
(74) *Attorney, Agent, or Firm*—Merek, Blackmon & Voorhees, LLC

(57) ABSTRACT

A number of different embodiments of illuminated electrical cords and outlets are provided. Some embodiments include a light source within at least one connector end of an electrical cord, with the cord having a translucent outer cover for emitting the light radially from the connector end light source. The cord may be a household electrical or extension cord, a computer power supply cord, auxiliary power cord, etc., as desired. A kit may be provided to adapt a conventional, non-illuminated cord to provide illumination therefrom. Other embodiments include electrical outlets, adapters, and power strips having a light source(s) therein, for illuminating an electrical cord installed in the electrical power source. The outlets, adapters, and power strips may include differently colored lighting, and/or multiple colored lenses for manual or automated selection of color output. Battery power may be provided, with automated switching in the event of a primary power failure.

20 Claims, 11 Drawing Sheets

ILLUMINATED ELECTRICAL CORDS AND OUTLETS

REFERENCE TO RELATED PATENT APPLICATION

This application claims the benefit of U.S. Provisional Patent Applications Ser. Nos. 60/356,978, filed on Feb. 14, 2002, and 60/363,606, filed on Mar. 12, 2002.

BACKGROUND OF THE INVENTION

1. Field of the Invention

The present invention relates generally to electrical power cords and electrical outlets therefor, and more specifically to means for illuminating the cords substantially along their entire lengths. Illuminated outlets and connectors are also provided.

2. Description of the Related Art

Electrical and extension cords, power supply and data transmission cables, and other types of cords and cables carrying electrical energy and signals, conventionally comprise one or more internal conductors surrounded by an electrically insulating, opaque cover or sheath. In certain rare instances, a translucent or transparent outer cover or sheath has been provided for the electrical conductor(s) in such wiring. However, the purpose of such translucent or transparent covering, is merely to provide a different appearance for the wire than that provided by conventional opaque insulation material.

Electrical cords and cables of various types are often used in areas of relatively low illumination, and/or are extended across the floors of rooms, hallways, and other areas of pedestrian foot traffic. Yet, with the exception of a relatively few devices developed in the past (addressed in the discussion of the related art below), no illumination has been provided for such electrical cords, to alert persons as to their location for avoidance of the cord(s), and to indicate the presence of an electrical supply or current running through the cord.

The present invention responds to this problem by providing a series of embodiments of electrical cords, cables, and the like, comprising one or more electrical conductors surrounded by a translucent or transparent insulating material which emits light radially therefrom when light is transmitted through the material. The present invention also includes various embodiments of electrical connectors formed integrally with the cords, which connectors include light emitting means for providing light to the light transmissive elements of the cords. The present invention further includes various embodiments of electrical outlets which include lighting means therein for supplying light to the illuminated cords of the present invention, and means for adjusting the color of the light emitted from those outlets.

A discussion of the related art of which the present inventors are aware, and its differences and distinctions from the present invention, is provided below.

U.S. Pat. No. 3,757,102 issued on Sep. 4, 1973 to Earl W. Roberts, titled "Lamp Capsule," describes a neon bulb encapsulated within a translucent capsule, which assembly is in turn installed within a translucent electrical receptacle or connector. The neon bulb is electrically connected to the electrical conductors within the electrical receptacle or connectors, so the bulb, and thus the receptacle or connector, is illuminated whenever electrical power is provided or when the electrical connector is connected to an active source of electrical power. While the Roberts device serves to provide an indication of active electrical power and also indicates the location of the electrical outlet or connector when the device is illuminated, it stops short of providing the benefits of the present invention, with its essentially continually illuminated electrical cords and means for illuminating the cords.

U.S. Pat. No. 3,942,859 issued on Mar. 9, 1976 to Miklos B. Korodi, titled "Electrical Conductor With Light Indicating Means," describes various embodiments of an illuminated electrical conductor. In one embodiment, the light emitting element is a light bulb contained within the connector at one end of the cord, and transmits its light along a fiberoptic line which runs the length of the cord. In another embodiment, a series of discontinuities is provided in the fiberoptic strands, resulting in an illuminated cord having a series of discontinuous "dots" of light emanating therefrom. Yet another embodiment includes a neon filled channel running the length of the cord, with the channel having an electrode at each end to excite the neon gas to cause the cord to illuminate. In contrast, the present invention utilizes at least one light emitting diode (LED) disposed within at least one of the connector ends of the cord, with appropriate voltage reduction circuitry as required to provide the proper voltage for the LED. Alternatively, the LED(s) may be located within an electrical receptacle or outlet, with means provided for light communication between the receptacle or outlet and the cord body. A color wheel may be provided with the present system, to provide different colors of light emission from the cord as desired, either by manually adjusting the wheel, or automating rotation of the wheel. The present invention may also provide for automatic illumination of the outlet(s) and cord(s) connected thereto in the event of an electrical power failure, by means of a battery powered backup system.

U.S. Pat. No. 3,995,152 issued on Nov. 30, 1976 to Albert Chao et al., titled "Electrical Lighting Structure Built-In A Molded Plastic Cord Or Cable," describes a lighting system incorporating a series of small, baseless incandescent bulbs installed along the length of a flexible or rigid translucent tube. Chao et al. note that the tube may carry additional wiring. However, the lights of the Chao et al. device result in a series of spaced apart, discontinuous lights within the tube, rather than a continuously lighted cord or cable, as in the case of the present invention. Chao et al. do not provide any lighting means within a connector or receptacle at the end(s) of their device.

U.S. Pat. No. 4,118,690 issued on Oct. 3, 1978 to William C. Paynton, titled "Electrical Hazard Indicator," describes an electrical cord having a small neon bulb installed in the male connector end of the cord. The neon bulb is wired in such a way that it will illuminate at least momentarily when the male prongs are inserted into an electrically active receptacle. However, the Paynton device does not provide any lighting for the cord itself for providing any alert or warning to persons in the area of the location of the cord, nor does Paynton provide any lighting means within an electrical outlet or receptacle, as provided by the present invention.

U.S. Pat. No. 4,597,033 issued on Jun. 24, 1986 to Daniel H. Meggs et al., titled "Flexible Elongated Lighting System," describes a lighting system comprising a flexible or semi-flexible translucent tube with a series of LED lighting elements installed therein. Meggs et al. intend their lighting system to be used primarily as an emergency system to indicate doorways, etc. where standard electrical lighting has failed. The Meggs et al. system differs from the present invention in that the Meggs et al. lighting system spaces the LEDs along the length of the light emitting element, rather than only at one or both ends thereof, as in the case of the present device. Also, Meggs et al. do not provide for any electrically conductive elements in addition to the conductors for the LEDs, i.e., they do not form their device as an electrical cord, whereas the present invention comprises an illuminated, electrically conductive cord or cable.

U.S. Pat. No. 4,671,597 issued on Jun. 9, 1987 to Edward Grill, titled "Power Indicator Light," describes a male electrical plug having a neon indicator light therein to indicate when the associated electrical cord is receiving power from the electrical receptacle into which the plug is inserted. The resulting device closely resembles the illuminated electrical plug of the Paynton '690 U.S. patent, discussed further above. The same points raised in the discussion of the Paynton '690 U.S. patent, are seen to apply to the Grill illuminated electrical plug as well.

U.S. Pat. No. 4,984,999 issued on Jan. 15, 1991 to Sam S. Leake, titled "String Of Lights Specification," describes an electrical line comprising two conductors which receive a relatively low voltage from a transformer. The transformer is adapted for plugging into a conventional electrical receptacle. A series of LEDs is installed along the length of the electrical line, with contact elements which penetrate the insulation of the electrical line to connect electrically with the conducting wires therein. Leake does not provide any other electrical conductors for powering equipment directly from the conventional electrical receptacle into which the transformer is plugged, whereas the present invention includes such conducting elements. Moreover, the Leake apparatus does not include a translucent insulating sheath for the conducting elements and cannot transmit light thereal-ong, as provided by the present invention. The Leake light string is essentially an opaque cord having a series of external point sources of light therealong, rather than continuous light emission.

U.S. Pat. No. 5,007,857 issued on Apr. 16, 1991 to Duane E. Wright, titled "Electrical Receptacle With Power Indicator Light," describes a receptacle end for an extension cord, or a male-female adapter receptacle, with an indicator light therein. Plugging an electrical device into the receptacle end of the electrically active extension cord, or the adapter, closes a circuit across a neon light within the receptacle or adapter, to indicate that electrical power is being supplied to the electrical device. The present invention also provides an indication of electrical power delivery through the electrical cord or cable, but does so using a completely different principle, wherein an LED light disposed within the receptacle end of the cord, illuminates the translucent insulating sheath of the cord in a continuous manner along its entire length.

U.S. Pat. No. 5,051,733 issued on Sep. 24, 1991 to Donald Neuhouser, titled "High Voltage Indicator Device," describes the installation of a series of wire wraps about the circumference of a high voltage line, with the circumferential wires connected to one or more remotely located fluorescent tubes. When the high voltage line is energized, a voltage sufficient to light the fluorescent tube(s) is induced in the circumferential wire wrap, causing the tubes to light and indicate high voltage in the line. The line itself of the Neuhouser system is not lighted, whereas the present invention provides continuous lighting along the length of the cord or line, no more than low voltage passing through the line for powering an optional LED at the opposite end of the cord.

U.S. Pat. No. 5,065,142 issued on Nov. 12, 1991 to Peter J. Green, titled "Voltage Pickup Circuit And Flashing Display For High Voltage Indicator Device, And Input Electrode Therefor," describes a warning device very similar to that of the Neuhouser device discussed immediately above. Green uses a capacitive plate wrapped about the high voltage line, with the charge picked up by the plate being used to illuminate a remotely located neon light or activate a piezoelectric buzzer. As in the case of the Neuhouser system, the Green warning system does not illuminate the electrical line itself, but rather serves to illuminate a remotely situated warning light. In contrast, the present invention illuminates the translucent body of the cord itself, but does not apply any voltage to the translucent insulating body of the cord.

U.S. Pat. No. 5,207,594 issued on May 4, 1993 to Thomas R. Olson, titled "Electrical Power Extension Cord," describes embodiments of a cord having translucent end connectors with neon lights therein. The lights are connected across either the electrically active ("hot") and neutral elements of the connector, or between the electrically active element and a ground. When electrical power is connected to the cord, the neon lights are illuminated, to light the translucent connector bodies. The Olson device thus relates more closely to the devices of the Paynton '690, Grill '597, and Wright '857 U.S. patents, all discussed further above, than it does to the present invention with its continually lighted translucent cord length.

U.S. Pat. No. 5,283,429 issued on Feb. 1, 1994 to Steve Campolo, titled "Fiber Optical Monitoring System For Electrical Conductors And The Like," describes a fiberoptic system in which the optical fiber core and cladding each have refractive indices differing from one another and varying with temperature and strain. An external sensor senses the amount of light refracted from the cable and cladding, and actuates a circuit interrupter in the event the temperature and/or strain exceed(s) a predetermined value(s). Campolo does not provide any continuous, radially emitted illumination for the entire length of his fiberoptic cable, as is provided by the present invention, nor does he disclose the use of LED lighting for illuminating his cable, whereas the present system uses such LED lighting strictly for visual purposes, rather than for transmitting a signal.

U.S. Pat. No. 5,470,252 issued on Nov. 28, 1995 to Philip E. Fladung, titled "Light-Permeable Extension Cord Connector," describes an extension cord and connector elements each having an indicator light (neon, etc.) therein, connected across the electrical contacts of the connector. The indicator light is illuminated when the cord is connected to an electrical power source. No illumination of the cord length itself is disclosed by Fladung. The Fladung device thus more closely relates to the devices of the Paynton '690, Grill '597, and Wright '857 U.S. patents, all discussed further above, than it does to the present invention with its continually lighted translucent cord length.

U.S. Pat. No. 5,602,948 issued on Feb. 11, 1997 to Joseph E. Currie, titled "Fiber Optic Illumination Device," describes a fiberoptic cable providing both radial and axial illumination therefrom. The radial illumination enables the device to serve as a visual warning device, while the axial illumination provides light from a remote source to an area where light is required. However, the Currie device does not include any electrical conductors running along the length of the fiberoptic cable, unlike the present invention wherein the primary portion of the device comprises one or more electrical conductors encased within a translucent insulating sheath for illuminating the length of the cord or line. As the Currie device does not include an electrical conductor(s) therein, no provision is made for connecting either end to an electrical power source.

U.S. Pat. No. 5,838,860 issued on Nov. 17, 1998 to Brett M. Kingstone et al., titled "Fiber Optic Light Source Apparatus And Method," describes various embodiments of a fiberoptic cable and light source therewith. The light source may include a rotary wheel having a series of differently colored lenses therein, for producing light having selectively different colors through the fiberoptic cable. The Kingstone et al. cable may also emit light laterally, according to the disclosure. However, Kingstone et al. do not provide any form of electrical conductor extending through their fiberoptic cable, and thus cannot use their cable as an extension cord to power a remotely located electrical device, as can the present invention.

U.S. Pat. No. 5,964,616 issued on Oct. 12, 1999 to Kenneth D. Eisenbraun, titled "Lighted Accessory Power Supply Cord," describes an automotive auxiliary electrical cord device for plugging into the conventional cigarette lighter socket in a motor vehicle. While Eisenbraun provides electrical conductors extending from the plug, the conductors and cord are not illuminated along their length, as is the cord of the present invention. Rather, Eisenbraun provides a light internally within the body of the plug, and a lens to direct the light outwardly from the plug body. The light is only disposed at the plug, and does not illuminate the cord length, as it does with the present illuminated extension cord invention.

U.S. Pat. No. 6,159,037 issued on Dec. 12, 2000 to Brent D. Madsden et al., titled "Illuminated Connector," describes various embodiments of connectors or plugs adapted for use in connecting computer cables and the like to one another and to a computer(s). The plug or connector body is translucent, with an external light source (not shown in the disclosure) being used to direct light into the connector body to illuminate the body. Madsden et al. do not provide any means of illuminating a connector cord extending from their connector plug body, whereas the present invention includes means for illuminating the elongate cord or electrical line, as well as illuminating the outlets, adapters, and/or power strips to which the present illuminated electrical cords may be connected.

U.S. Pat. No. 6,319,051 issued on Nov. 20, 2001 to Chih-Kai Chang, titled "Electric Connector With A Light Penetrable Socket Shell," describes a connector socket for use in the computer field, with the socket including a translucent internal body into which the plug is inserted. Electric power to the connector results in LEDs within the external housing illuminating the internal shell, with light being emitted from the shell and outwardly from the plug receptacle of the shell. The Chang device is thus more closely related to the Madsden et al. '037 connector discussed immediately above, than to the present invention, as Chang does not disclose any means for illuminating the electrical cord extending from the connector.

Finally, U.S. Pat. No. 6,336,825 issued on Jan. 8, 2002 to Roland Seefried, titled "Electrical Connector With Light-Guiding Body," describes various connector and translucent lens configurations in which LEDs are used, with the lenses spreading their light emissions more broadly for better viewing. The Seefried connector is more closely related to the connectors disclosed in the Madsden et al. '037 and Chang '051 U.S. patents than to the present invention, as Seefried does not disclose any means of illuminating an electrical cord extending from his connector.

None of the above inventions and patents, taken either singularly or in combination, is seen to describe the instant invention as claimed. Thus illuminated electrical cords and outlets solving the aforementioned problems, are desired.

SUMMARY OF THE INVENTION

The present invention comprises various embodiments of illuminated electrical cords, i.e., cords including at least one electrical conductor element therein and having a translucent, electrically insulating outer cover or sheath which transmits light therethrough. In one embodiment, a lighting element (LED device, etc.) is installed in at least one connector end of the cord, with the LED being activated by electrical power from the electrical outlet or other electrical connector to which the cord is connected. The cable or cord may include at least some end light emission as well as side light emission, for use as a light supply at the outlet end of the cable or cord. The present invention further includes various electrical outlets, adapters, and power strips having LED illumination therein. Another embodiment of the present electrical cord is illuminated when connected to such illuminated outlets and the like.

The illuminating electrical outlets, adapters, and power strips of the present invention may also include colored lenses, and/or the LEDs may produce colored light as desired. Another embodiment of the present invention provides a color wheel having a series of differently colored lenses therein, with the user of the present invention selecting the color desired, or with colors being periodically changed by a motorized drive for the wheel. The LEDs within the outlet, adapter, or power strip units may include battery backup power and automatic switching means to activate the LED illumination in the event of a power failure.

Accordingly, it is a principal object of the invention to provide illuminated electrical cords and the like, with the cords being illuminated by lighting means within the connector end(s) of the cord, or alternatively by lighting means disposed within an electrical outlet, adapter, or power strip to which the illuminated cord is connected.

It is another object of the invention to provide illuminated electrical outlets, adapters, and power strips, having internal lighting means for transmitting light to the illuminated electrical cords of the present invention.

It is a further object of the invention to provide variably colored lighting for the present illuminated electrical cords, by means of a plurality of differently colored lenses and/or differently colored LED lights, with the lenses being manually or automatically adjustable as desired.

Still another object of the invention is to provide a battery powered backup system for the present illuminated cords and outlets, with the battery backup power being activated automatically in the event of an electrical power failure.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises illuminated electrical cords and illuminated electrical outlets therefor. In some of the embodiments of the present invention, the electrical cords include lighting means integrated within one or both of the end connectors of the cord. In other embodiments, the cords receive light output from the illuminated outlets of the present invention. In all cases, the illuminated cords have a translucent outer cover or sheath which emits light radially therefrom when light is transmitted into the translucent sheath from either or both ends thereof. The present cords are not only decorative when illuminated, but also serve to facilitate electrical connections of devices in poorly lighted areas. The present illuminated cords also provide significant safety advantages when used in otherwise unlighted areas, as their illumination makes them readily visible in order to mark their presence to allow persons to avoid tripping over such cords.

Figure 1A:
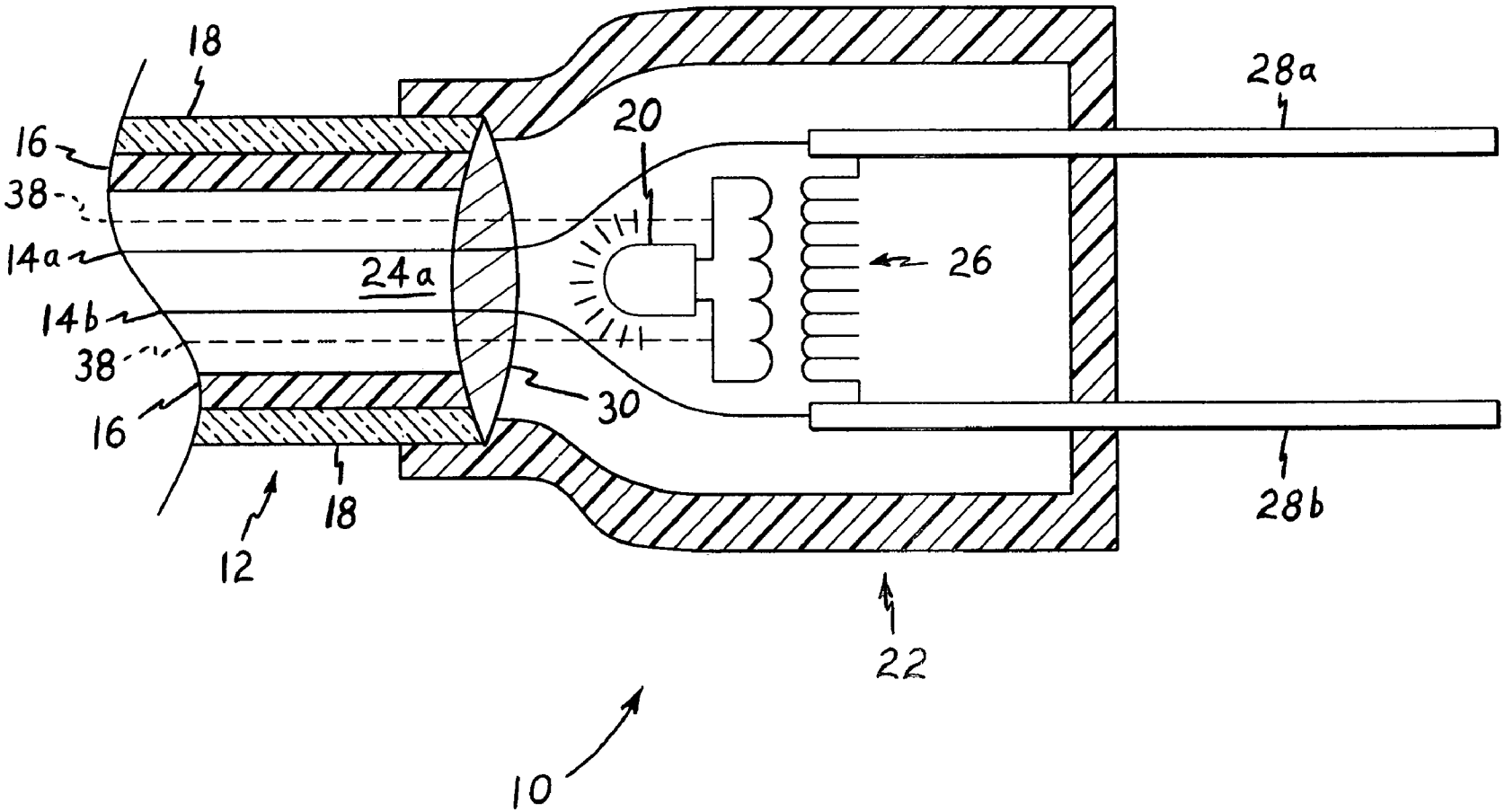
FIG. 1A is a schematic plan view in section of an exemplary male connector with an illuminated cord according to the present invention, illustrating the components thereof.

FIG. 1A of the drawings illustrates a male electrical cord end and connector 10 of the present invention. The electrical cord 12 includes a pair of electrical conductor elements 14*a* and 14*b* therein, with an electrically insulating jacket or cover 16 disposed therearound. The insulating cover 16 may be formed of opaque, translucent, or transparent material, as desired. While the insulating cover 16 may be used to transmit light from the cord assembly 10 when the cover 16 is formed of a transparent or translucent material, normally the cover 16 is formed of an opaque flexible plastic material, as is conventional in the art. In such cases, an outer wrap or cover 18 of transparent or translucent flexible material is applied over the insulating cover 16, as shown in FIG. 1A of the drawings. This transparent or translucent outer cover 18 is an optically transmissive material, which receives light from one or both ends thereof and re-radiates the light radially from the cover in a continuous and unbroken array.

Figure 2:
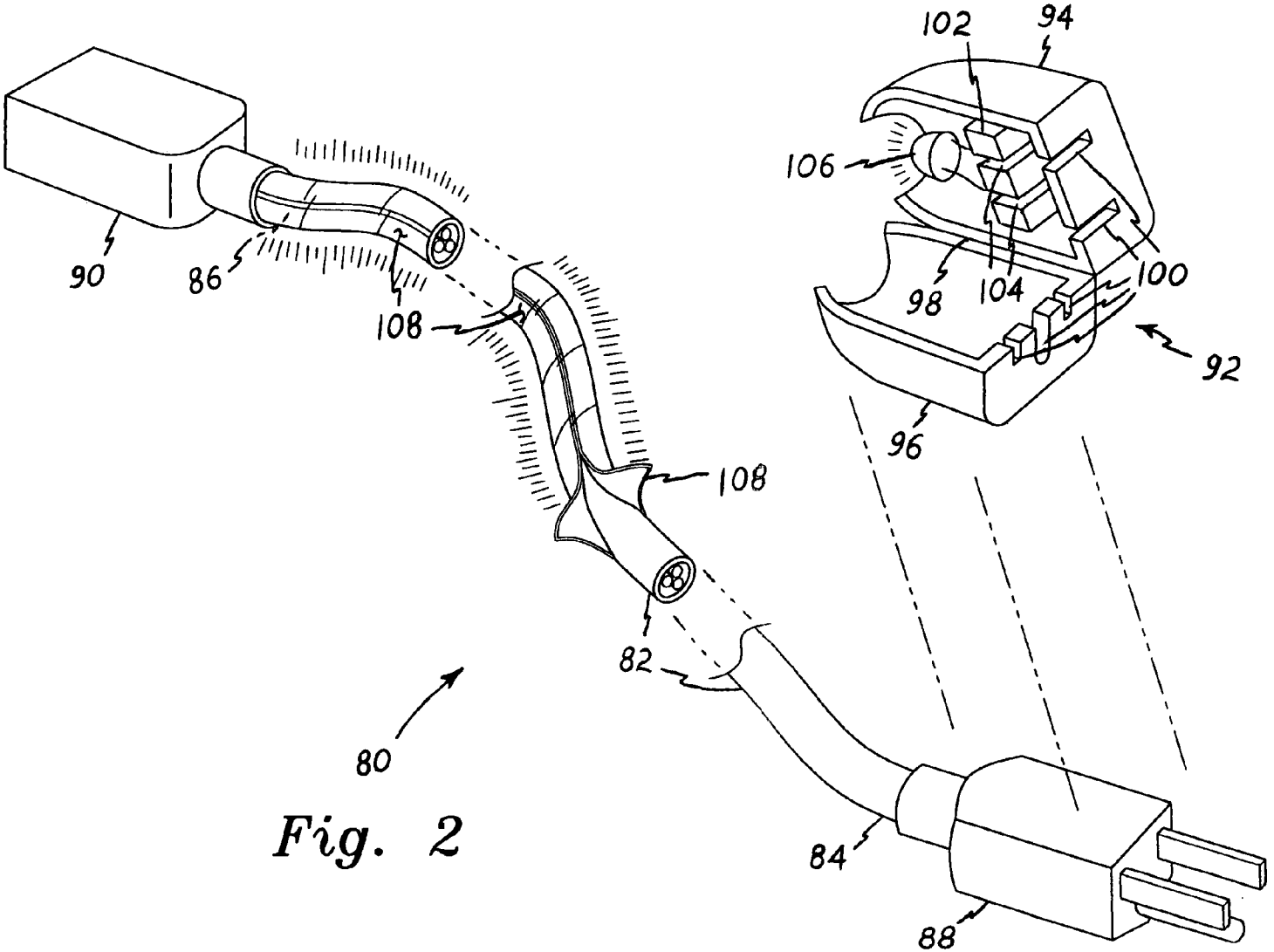
FIG. 2 is an exploded perspective view of an alternative embodiment of the present invention, comprising cord and connector covers for adding to a conventional cord to illuminate the cord.

Light is transmitted to the light transmissive cover 18 by a light 20 disposed at or within one or both of the end connector(s) of the electrical cord. Where the electrical cord is a permanently installed appliance cord or the like, the light 20 is installed within the male connector body 22 of the cord, which extends from the distal first end 24*a* of the electrical cord. However, the present invention is also adaptable to extension cords having opposed first and second ends with a male and a female electrical connector extending therefrom, with a light in each connector portion, as illustrated in FIG. 2 and described further below.

The light 20 installed with or within the connector body 22 is preferably a light emitting diode (LED). LEDs of the present state of the art are capable of providing exceptionally bright light output with relatively low power requirements, produce very little heat, and may be selected to produce virtually any color light output desired. In the event that an LED is used for the light source 20, some form of voltage reduction must be provided. Accordingly, a transformer 26 is connected across the two male prongs 28*a* and 28*b* which extend from the connector body 22, in order to supply the LED 20 with the proper voltage. No other circuitry is required, as the LED itself serves as a rectifier for the conventional alternating current received by the cord 10. It will be seen that the present invention may also be used with a DC circuit (examples of connectors used with such circuits are illustrated in FIGS. 1C and 1D and discussed further below), so long as the voltage and polarity are correct for the LED.

A focusing lens 30 is installed within the end 24 of the cord 12, generally between the connector body 22 and the cord 12. The central portion of the lens 30 is not critical to the function of the cord and connector 10 of FIG. 1A, and in fact may be omitted. The critical portion of the lens 30 is the outer edge thereof, which is aligned with the outer translucent sleeve or sheath 18 which transmits the light radially from the cord assembly 10.

The LED 20 or other light receives electrical power from the transformer 26, which in turn receives power from the two male prongs 28*a* and 28*b* when they are connected to a conventional electrical outlet. Light emitted from the LED or light 20 passes through the edges of the lens 30, where it is directed along the translucent outer sheath 18 of the cord 12. The light is then re-radiated outwardly from the sides of the sheath 18 to illuminate the cord 12. Also, in some embodiments, the connector body 22 may be formed of a transparent or translucent material if so desired, so that the light from the LED 20 will illuminate the connector body 22 as well as the cord 12.

Figure 1B:
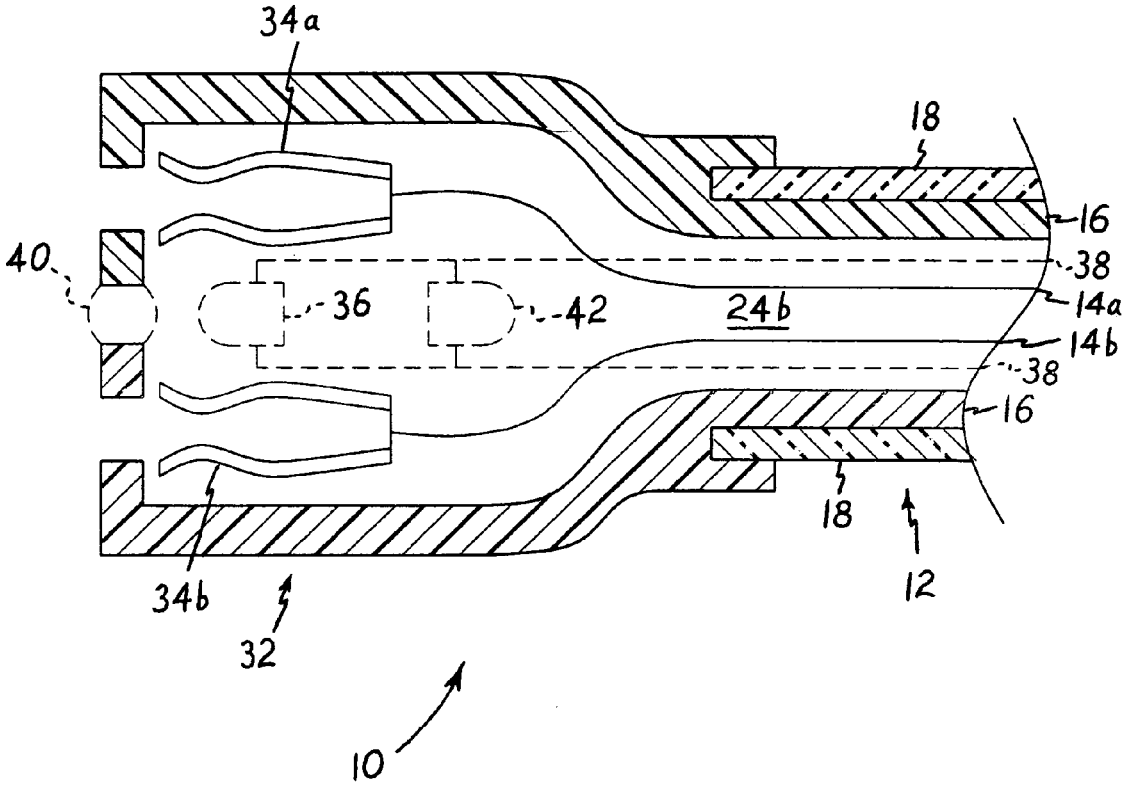
FIG. 1B is a schematic plan view in section of an exemplary female connector of the opposite end of the cord of FIG. 1A, illustrating the components thereof.
Figure 1C:
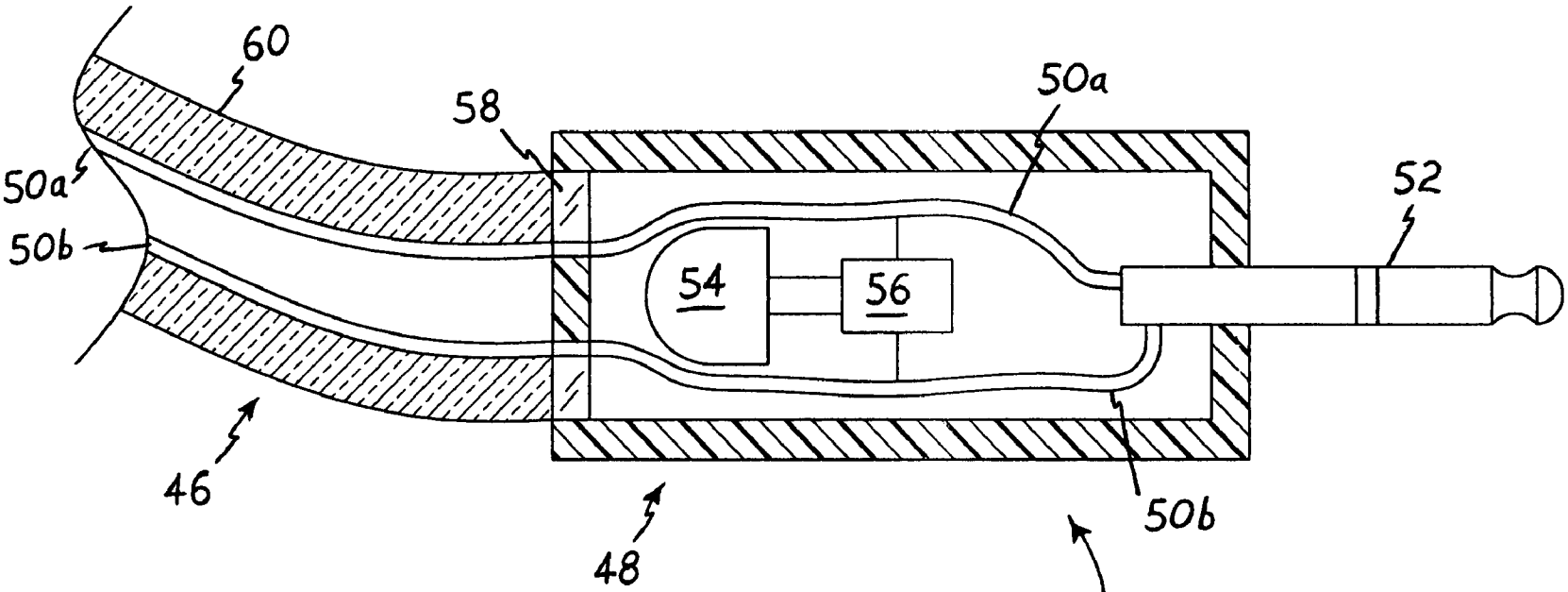
FIG. 1C is a schematic plan view of a phone jack type connector and cord configuration according to the present invention, illustrating the components thereof.
Figure 1D:
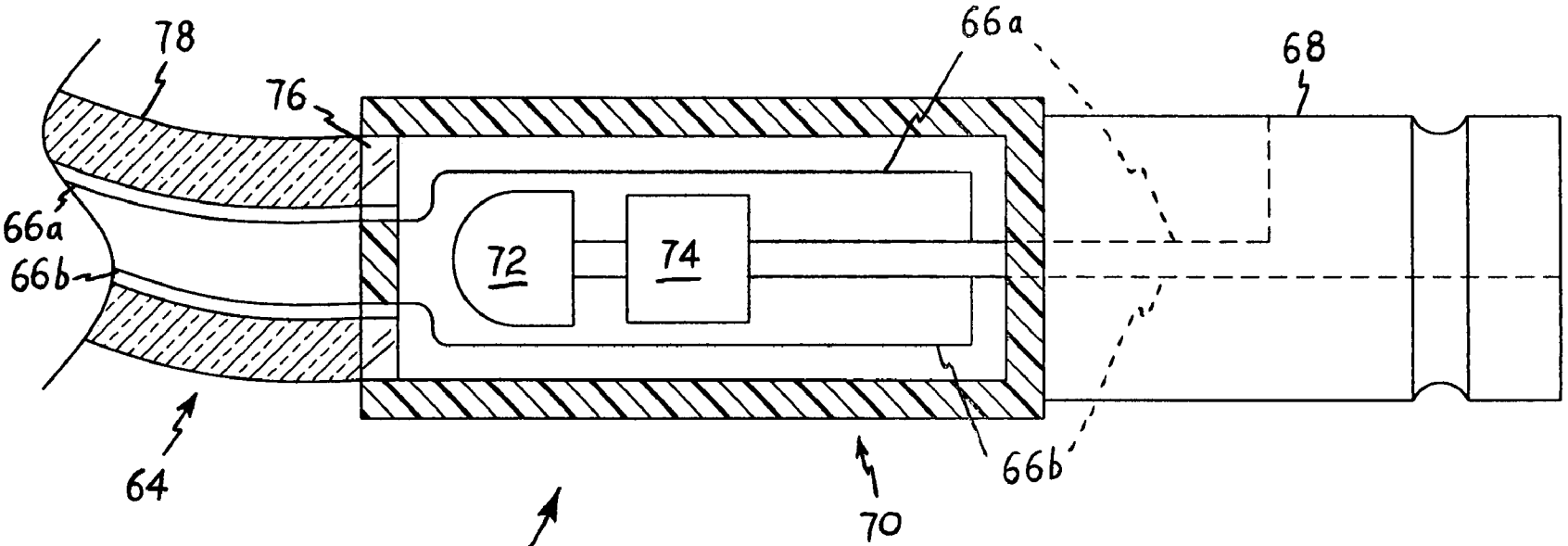
FIG. 1D is a schematic plan view of an auxiliary power plug type connector and cord configuration according to the present invention, illustrating the components thereof.

FIG. 1B illustrates an opposite end female electrical connector 32 for the cord assembly 10. The second end 24*b* of the cord 12 terminates at or within the female connector 32, which houses the two female electrical contacts 34*a* and 34*b* of the assembly. The female connector body 32 may be formed integrally with the insulating cover or jacket 16 of the cord 12, as illustrated, or may be formed as a separate component. As in the case of the first or male connector end 22, the second or female connector 32 may be formed of translucent or transparent materials, in order to transmit light therefrom, if so desired. It will be seen that with the construction illustrated in FIG. 1B, that if the female connector body 32 is transparent or translucent, that the end of the translucent outer cover or sheath 18 will illuminate the connector body 32, when the outer cover 18 is illuminated.

Depending upon the length of the cord 12, the light output of the LED or other light 20 of the first or male connector body 22, the properties of the translucent outer cover or sheath 18, and perhaps other factors as well, a single LED 20 located at one end of the cord assembly 10 may be sufficient to illuminate the entire length of the cord 10. However, additional lighting may be installed with the opposite connector body or end 32, if so desired, as illustrated in FIG. 1B. An optional LED or other light 36 (shown in broken lines) is provided within the second connector body 32, directed to emit light outwardly and generally axially from the connector body 32. This light 36 may receive its electrical power by means of separate, dedicated electrical lines 38 (shown in broken lines) which extend from the first light 20 (FIG. 1A) to the second light 36. Alternatively, the second light 36 may be powered by a transformer within the connector body 32, in much the same manner as that illustrated in FIG. 1A.

An outwardly focusing lens 40 (shown in broken lines) is provided within the end of the connector body 32. Illumination of the light 36 results in the lens 40 directing light generally axially from the connector body 32, allowing its use as a light source or flashlight when the opposite end connector 22 is plugged into a power source. An additional internal LED or other light 42 may be installed with the second connector body 32, if so desired, to illuminate a translucent connector body 32, or to direct light back along the translucent outer cover 18 by means of a lens arrangement similar to that shown in FIG. 1A for the light 20.

FIG. 1C is an illustration of one end of an alternative electrical cord assembly 44 having lighting means in accordance with the present invention. (Only the removably connectable end of the assembly 44 is illustrated, with it being understood that the opposite end of the cord is permanently connected to an electrically powered or operated appliance of some type, e.g., a headset, etc.) The electrical cord assembly 44 includes a cord 46 terminating in a coaxial phone jack type connector plug 48, as used in headsets and other similar devices. The two wires 50*a* and 50*b* of the assembly 44 terminate at a coaxial contact pin 52, which extends from the distal end of the plug body 48.

An LED or other light 54 is installed within or at the plug body 48, and receives electrical power from a conventional transformer 56 which may be installed therewith as required, across the two wires 50*a* and 50*b* of the assembly. An annular lens 58 is installed at the end of the plug body 48 opposite the contact pin 52, and directs light outwardly from the LED 54 and into a transparent or translucent outer cover or sheath 60, which covers the two wires 50*a* and 50*b* of the cord assembly 44. Thus, when the contact pin 52 is plugged into its receptacle, the transformer 56 is energized to provide appropriate power to the light 54, which in turn emits light through the lens 58. The lens 58 passes the emitted light into the translucent outer sheath 60 of the cord assembly 44, whereupon the light is emitted radially from the sheath 60 to illuminate the cord assembly 44.

FIG. 1D illustrates yet another embodiment of the present invention, comprising an auxiliary power cord assembly 62 including illumination means therein. (Again, only the removably connectable end of the assembly 62 is illustrated, with it being understood that the opposite end of the cord is permanently connected to an electrically powered or operated appliance of some type, e.g., a light, air pump, etc.) The electrical cord assembly 62 includes a cord 64 terminating in a coaxial auxiliary power plug 70 adapted for connection to a power supply receptacle. The two wires 66*a* and 66*b* of the assembly 62 are connected respectively to the shell 68 and conventional center conductor (not shown) which extend from the auxiliary power plug connector end 70 of the assembly 62.

An LED or other light 72 is installed within or at the plug body 70, and receives electrical power from a conventional transformer 74 which may be installed therewith as required, across the two wires 66*a* and 66*b* of the assembly. An annular lens 76 is installed at the end of the plug body 70 opposite the contact shell 68, and directs light outwardly from the LED 72 and into a transparent or translucent outer cover or sheath 78 covering the two wires 66*a* and 66*b* of the cord 64. Operation of the illuminated electrical cord assembly 62 of FIG. 1D is similar to that described above for the assembly 44 of FIG. 1C, with the transformer 74 supplying appropriate electrical power to the light 72 when electrical contact is completed, thus illuminating the translucent outer cover 78 to emit light radially therefrom.

To this point, the various illuminated cord embodiments have been indicated as having the lighting systems integrated with the remainder of the cord and connector structures at the time of manufacture. However, the present invention also provides for the illumination means to be added to an otherwise conventional unlighted electrical cord and connector(s). FIG. 2 illustrates such an embodiment, in which an extension cord 80 is equipped with the illumination means of the present invention. The extension cord 80 before the addition of the kit for converting it to an illuminated cord, is conventional, essentially comprising an elongate electrical conductor and outer insulating assembly 82 having a first end 84 and opposite second end 86, with a first end connector 88 and second end connector 90 extending from the respective first and second ends 84 and 86.

One or both end connectors 88 and/or 90 may have a cord illuminating shell 92 applied thereover, as desired. The shell 92 may be formed of an opaque, translucent, or transparent flexible plastic material having two components 94 and 96 joined by a living hinge 98, or may have another configuration or be formed of another material as desired. Conventional latch means (e.g., snaps, etc., not shown) may be provided to lock the two components 94 and 96 together. Clearance slots 100 are formed in the two shell components 94 and 96, to clear the prongs of a male connector 88 when installed thereon or to allow insertion of the male contacts into a female connector 90 when the illuminating shell 92 is installed thereon.

A slotted internal contact block 102 is contained within the shell 92, with its slots 104 fitting around the male contact prongs of the male connector 88 or male contacts inserted into a female connector 90, when the illuminating shell 92 is installed thereon. The contact block 102 may contain a conventional transformer, shown schematically as component 26 in FIG. 1A of the drawings, or the transformer may be located elsewhere within the illuminating shell 92. It will be appreciated that such a transformer need not be very large, as the amperage required for the operation of the light, particularly in the case of an LED, is very low. A light 106, preferably an LED, is installed within the illuminating shell 92, and oriented to emit light along the cord 82 extending from the connector(s) 88 and/or 90, and illuminating shell 92 attached thereto.

Figure 3:
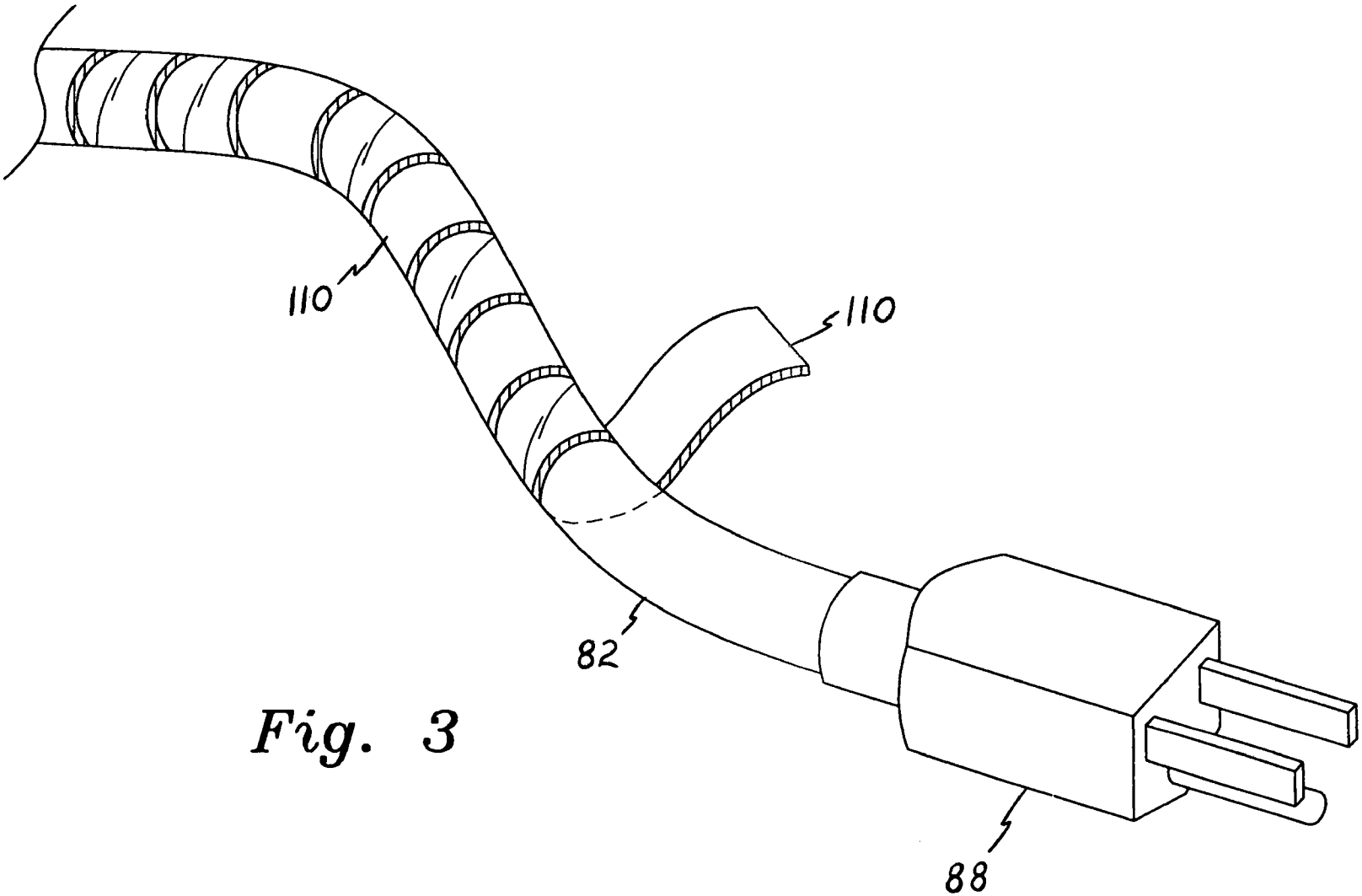
FIG. 3 is a perspective view of one end of an electrical cord, showing one means for applying a translucent outer cover thereto.

The cord 82 is wrapped with a transparent or translucent covering 108, which receives the light emitted from the light source 106 of the illuminating shell 92 and redirects or emits the light radially therefrom, to illuminate the cord assembly 82. The covering 108 may comprise a wrap which is applied longitudinally along and over the outer insulating material of the cord 82, and secured thereto by adhesive, or attached mechanically by plastic wire ties, etc., as desired. FIG. 3 illustrates an alternative embodiment of such a wrap. The wrap of FIG. 3 comprises an elongate translucent or transparent striped sheet 110 applied in a spiral pattern around and over the outer insulating material of the cord 82, and bonded thereto e.g. by heat, chemical reaction, etc.

Figure 4:
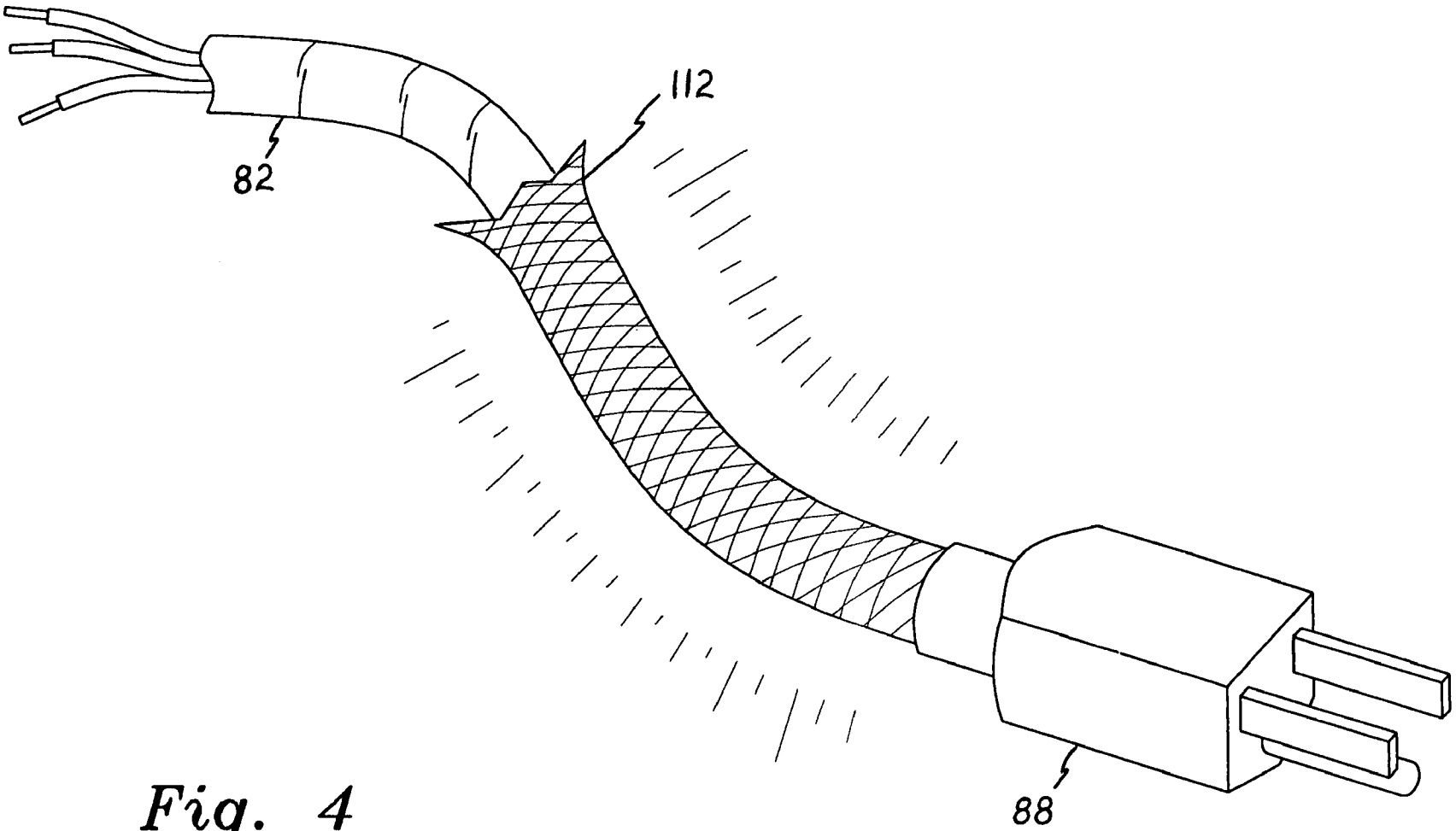
FIG. 4 is a perspective view of one end of an electrical cord, illustrating an alternative translucent cover thereover.

FIG. 4 illustrates yet another embodiment of an illuminated exterior wrap or sleeve for an electrical cord, in which a woven or braided sleeve 112 of translucent material (e.g., hollow core polyethylene rope, etc.) is passed over the electrical cord 82. The braided sleeve 112 may be expanded diametrically to pass over the relatively wider electrical connector end 88 of the cord assembly, or may be installed over the outer insulating jacket of the cord 82 before installing the connector 88 to the end of the cord. The connector 88 may include a light source integrally therewith, as in the example shown in FIG. 1A, or may be illuminated by an illuminated shell, as illustrated in FIG. 2 of the drawings.

Figure 5:
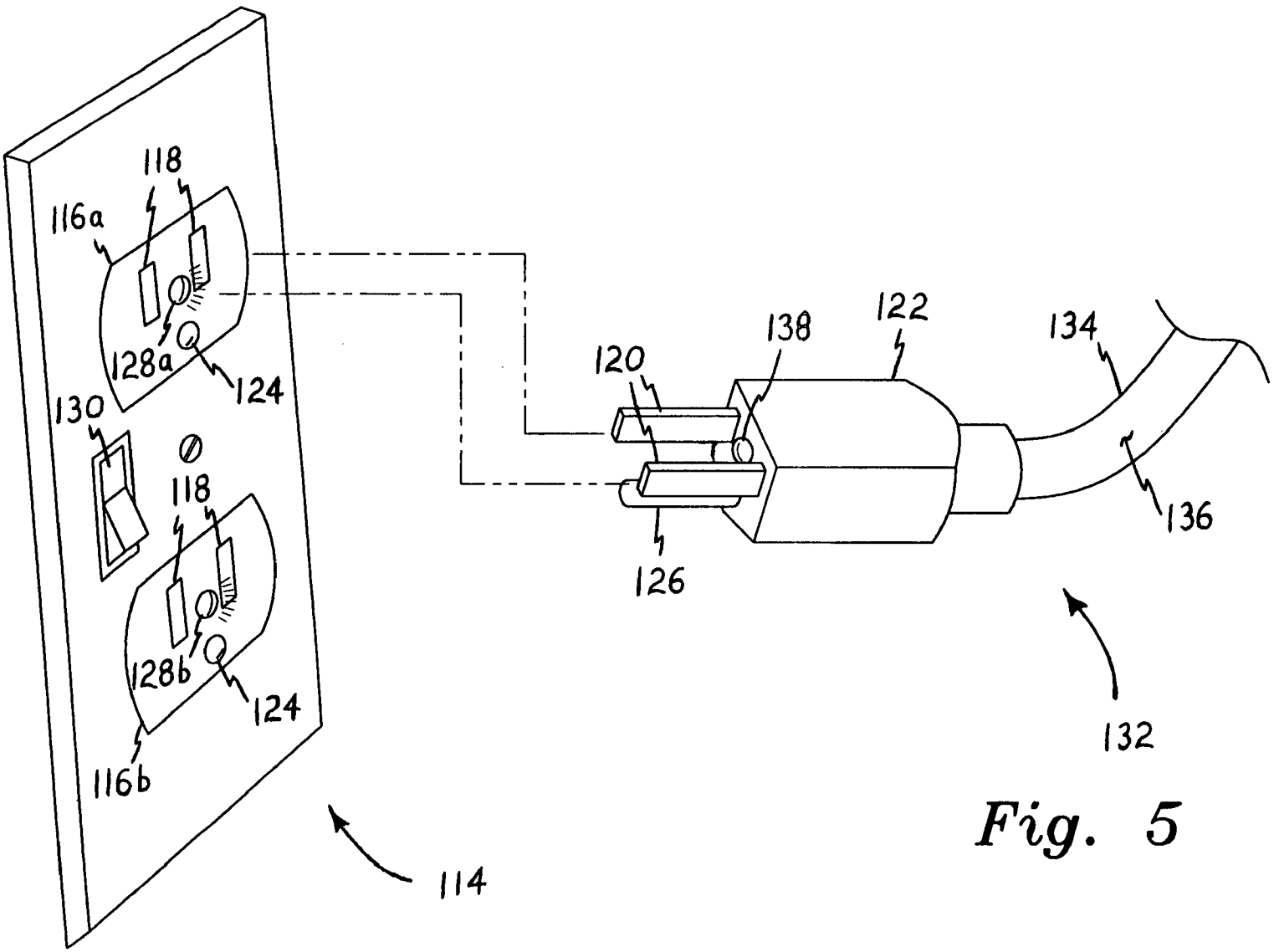
FIG. 5 is an exploded perspective view of another embodiment of the present invention, comprising an illuminated electrical outlet for illuminating an electrical cord installed therein.

Yet another embodiment of the present invention provides for electrical power outlets and the like, which also contain lighting therein for illuminating electrical cords which do not contain or include their own lighting means therewith. FIG. 5 illustrates one such embodiment, comprising an electrical outlet 114 (e.g., wall outlet, etc.) having a pair of electrical receptacles 116*a* and 116*b* therein. Each receptacle 116a and 116b includes the conventional electrical contact blade slots 118 for receiving the electrical contact blades 120 of an electrical connector plug 122, and may also include a grounding pin passage 124 to accept the ground pin 126 of the plug 122, if so equipped. It will be noted that each receptacle 116*a* and 116*b* also includes a light, respectively 128*a* and 128*b*, therein, e.g., an LED, or alternatively other light type. These lights 128*a* and 128*b* are oriented to emit light outwardly from their receptacles, and are controlled by a switch 130.

The electrical cord assembly 132 used with the illuminating receptacle 114, includes an elongate electrical conductor and insulator cord 134 from which the plug 122 extends. (The cord assembly 132 may comprise an extension cord, with a conventional female electrical connector at the opposite end thereof, somewhat like the cord assembly 80 of FIG. 2, or may comprise an electrical appliance cord with the opposite end being permanently connected to an electrical device of some sort.) The electrical cord and its outer insulating jacket 134 are covered with a translucent or transparent outer cover or wrap 136, examples of which are illustrated in FIGS. 1A through 4 of the drawings.

Rather than including an electrically powered light source within the plug 122 (or surrounding illuminated shell), the illuminated cord assembly 132 of FIG. 5 receives all of its light from the outwardly directed light 128*a* or 128*b* of the corresponding receptacle 116*a* or 116*b*, to which the electrical plug 122 is connected. The distal end of the plug 122, i.e., the end abutting the receptacle when the plug is installed therein, includes an inwardly focusing lens 138 which receives the light output from the appropriate light source 128*a* or 128*b* and focuses it through the plug 122 body to illuminate the translucent or transparent outer cover or wrap 136 of the cord 134. The illumination principle is generally similar to that disclosed in FIG. 1A of the drawings, but rather than having a light source integral with the plug body, the cord 132 of FIG. 5 receives its light from another source, i.e., the light 128*a* or 128*b* of the electrical outlet 114.

Figure 6:
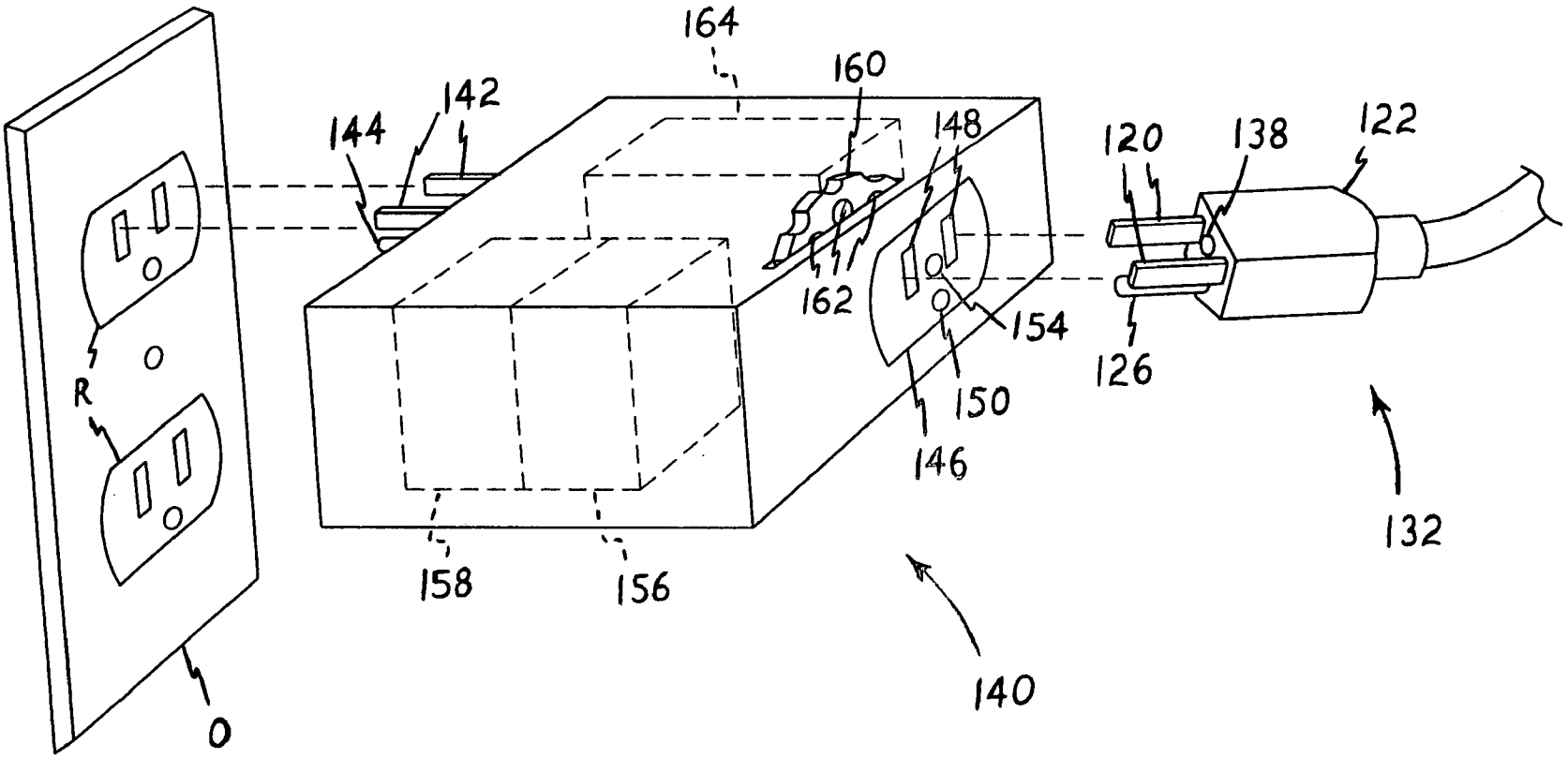
FIG. 6 is an exploded perspective view of a further embodiment of the present invention, illustrating an adapter for installation in a conventional outlet for illuminating an electrical cord.

FIG. 6 illustrates another embodiment of the illuminating electrical power sources or outlets of the present invention, comprising a portable adapter 140 which may be plugged into an electrical receptacle R of a conventional outlet O, and which provides illumination for a lighted electrical cord assembly which may be connected thereto. The adapter 140 includes a pair of male electrical contact prongs or blades 142, and may further include a ground pin 144 extending therefrom, which insert removably into one of the receptacles R of the outlet O. The opposite side or face of the adapter 140 includes an electrical receptacle 146 therein, having a pair of electrical contact blade slots 148 and which may further include a ground pin passage 150, which slots 148 and passage 150 are adapted to receive the mating electrical contact blades 120 and ground pin 126 of the electrical connector plug 122 of an illuminated electrical cord assembly 132, as shown in FIG. 5 and described in detail further above. Additional electrical receptacles, not shown but identical to the single adapter receptacle 146 shown in FIG. 6, may be provided in the adapter 140.

The adapter receptacle 146 also includes an LED or other light source 152 (shown in the block diagram of FIG. 7) and a lens 154. The lens 154 is positioned within the adapter receptacle 146 so as to be aligned with the inwardly focusing lens 138 of the connector plug 122 of the cord assembly 132 when the plug 122 is plugged into the adapter receptacle 146, in the manner described further above for the illuminated outlet receptacles 116*a*, 116*b* and illuminated cord assembly 132 of FIG. 5.

The adapter receptacle light 152 receives its power from a conventional transformer (not shown in FIG. 6, but using essentially the same circuitry as that illustrated schematically for the transformer 26 of FIG. 1A), which in turn receives electrical power from the outlet O when the adapter 140 is installed therein. Alternatively, the light 152 may be powered by a conventional electrical storage cell or battery 156 and rectifier and charger device 158, as shown in broken lines within the adapter 140 of FIG. 6. The addition of electrical battery power for the light 152 allows the adapter 140 to be used to illuminate electrical cords and the like where there is no other source of electrical power, allowing the present invention to be used e.g. on camping trips for illuminating tent ropes and the like equipped with a translucent outer wrap in the manner of the electrical cords of the present invention, and other similarly configured ropes, cords, lines, etc.

The adapter 140 of FIG. 6 may further include a device for changing or varying the color of light received by the electrical cord 132, if so desired. In FIG. 6, a color wheel 160 is installed immediately within the adapter receptacle 146, with the wheel 160 having a rotary axis or bearing disposed about one of the blade contact slots 148 and a series of lenses or segments 162 each having different colors from one another disposed circumferentially thereabout. The colored lenses 162 are positioned radially from the central rotary axis of the wheel 160 so as to align selectively with the lens 154 of the receptacle 146.

The color wheel 160 may be operated manually, by manipulating the serrated edge of the wheel 160 which extends from the case of the adapter 140 to position a specifically colored lens or segment 162 between the light 152 and lens 154 as desired. Alternatively, the adapter 140 may include a conventional electric motor and reduction drive 164 (shown in broken lines in FIG. 6), which automatically rotates the color wheel 160 in order to vary the colors emitted by the adapter 140 and thus the colors emitted by the illuminated cord 132. A conventional timer (noted in the block diagram of FIG. 7) may be incorporated with the device, to stop the drive system 164 for some predetermined period of time on each color, as desired. The electrical storage battery 156 may also be used to power the motor and reduction drive assembly 164, if so desired, thus allowing the automatic illumination of the cord 132 using different colors, without need for conventional 110–115 volt power.

Figure 7:
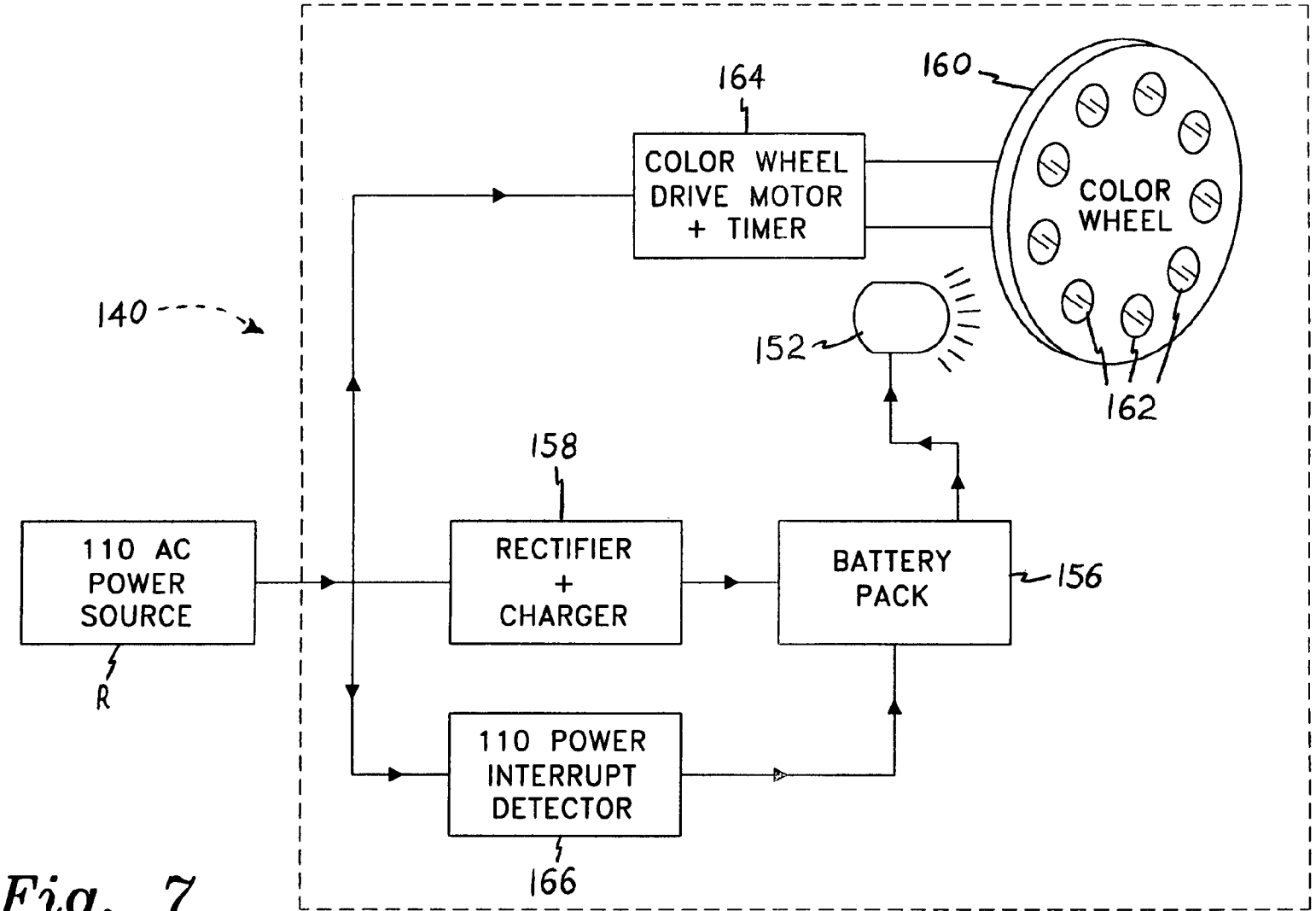
FIG. 7 is a block diagram illustrating the operative components of a color wheel for variably coloring the light emissions as desired for an illuminated electrical cord.

FIG. 7 is a block diagram illustrating the relationship between the various components of the adapter 140 of FIG. 6. In FIG. 7, all of the various components of the adapter 140, i.e., a light 152, battery pack 156, rectifier and charger 158, color wheel 160, and drive motor and timer assembly 164 for the color wheel, are shown within the case or housing of the adapter 140, represented by a broken line around the above noted components. A conventional power interrupt detector 166, operates to activate the battery pack 156 automatically when loss of power from the electrical receptacle R is detected.

Figure 8:
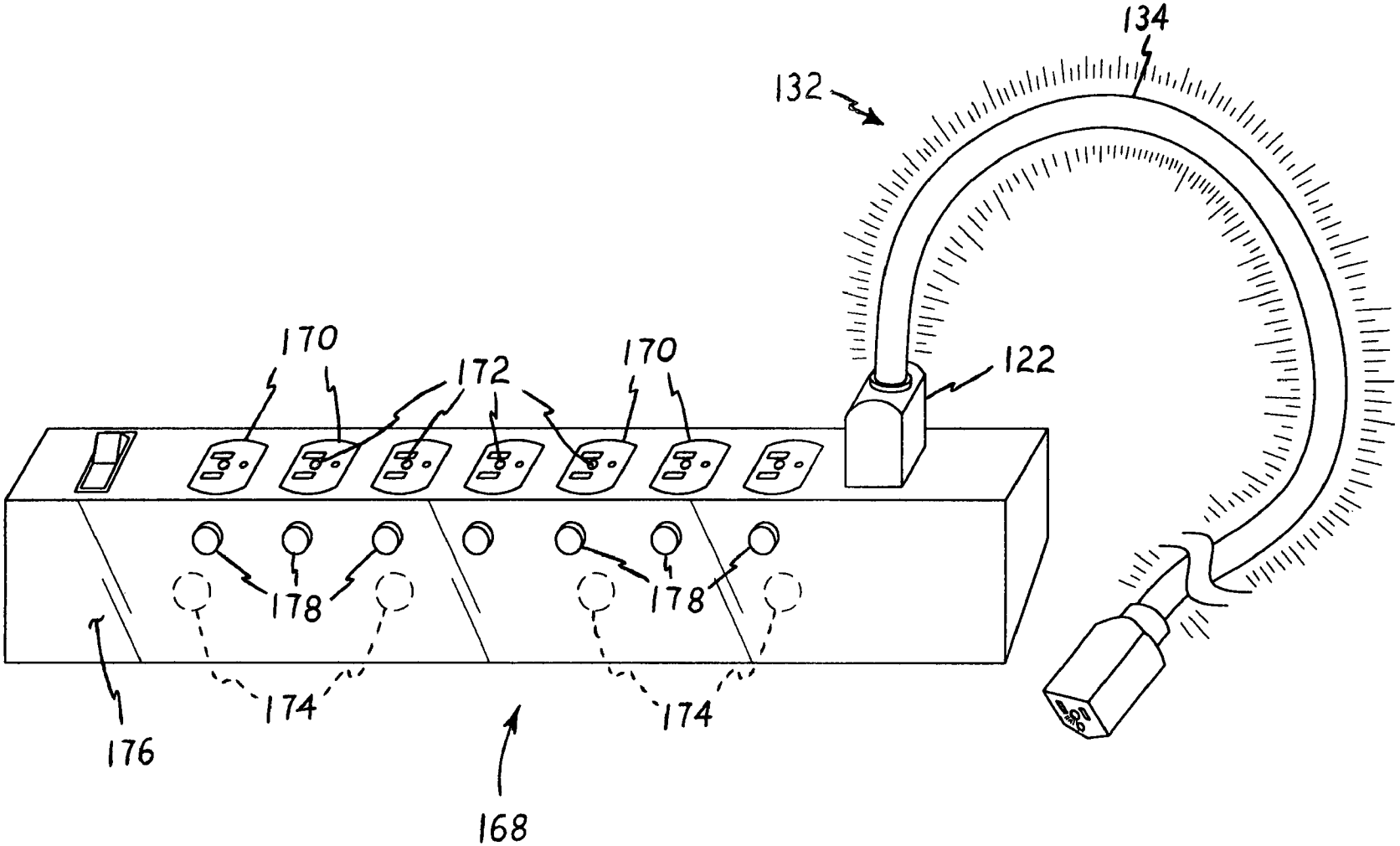
FIG. 8 is a perspective view of a power strip having a translucent body with internal lighting, and providing illumination for an electrical cord as well.

FIG. 8 of the drawings illustrates still another embodiment of the present invention, comprising an illuminated power strip 168 which may be used to illuminate an illuminated cord assembly 132. The power strip 168 includes a conventional power cord (not shown), which is installed in a conventional electrical receptacle, e.g., a receptacle R of the outlet O of FIG. 6, to supply electrical power to the power strip 168. The power strip 168 includes a series of illuminating electrical receptacles 170 therein, with each of the receptacles 170 having a light 172 (e.g., LED, etc.) therein, similarly to the illuminating receptacles 116*a* and 116*b* of FIG. 5 of the drawings. Each receptacle light 172 is positioned within its respective receptacle 170 so as to shine into the internally directed lens in the end of the male plug end 122 of the cord assembly 132, as shown in FIG. 5 of the drawings.

The power strip 168 includes one or more lights (LEDs, etc.) 174 therein. Preferably, the outer case, shell, or housing 176 of the power strip 168 is formed of translucent or transparent material, with the internal light(s) 174 serving to illuminate the power strip 168 when electrical power is applied thereto. In addition, the light 172 of each of the electrical receptacles 170 is controlled by a switch 178 (e.g., push button switch, as shown, or rocker, toggle, etc. switch). Each of the receptacle lights 172 may be a different color from one another, and/or be colored differently by means of differently colored lenses, if so desired.

The power strip 168 of FIG. 8 may also include essentially the same circuitry as that disclosed in the adapter of FIG. 6 and discussed further above, i.e., one or more color wheels for varying the color output of the lights 172, motor means for driving the color wheel(s), a battery powered backup system for illuminating the lights 172 and/or 174 in the event that external electrical power is not available, and a rectifier and charging system to automatically maintain the battery charge when the device is connected to an external electrical source (e.g., 110–115 volt outlet).

In conclusion, the present illuminated electrical cords and outlets provide a much needed means of illuminating electrical cords and the like in areas of relatively low illumination. The present invention lends itself not only to use with appliance and extension cords, but also to auxiliary power cords, computer and telephone power and data cords, etc. The present invention also includes means for modifying a conventional electrical cord with an illuminating outer cover, which cord may be used with one of the illuminating outlets of the present invention. Such outlets may comprise wall outlets, portable adapters, and power strips, each of which includes means for illuminating a properly configured electrical cord which is installed therein. Such outlets may also include means for coloring the light output therefrom, as desired. The present illuminated cords and outlets thus not only provide an important safety function for electrical cords in areas of low illumination, but also provide a decorative function as well.

It is to be understood that the present invention is not limited to the embodiments described above, but encompasses any and all embodiments within the scope of the following claims.

We claim:

1. An illuminated electrical supply line, comprising:

an electrical cord having an electrically insulating housing, a first end and a second end opposite said first end;

at least one electrical conductor disposed within said electrical cord housing;

a first end connector and a second end connector extending respectively from said first end and said second end of said electrical cord;

a selectively removable, translucent cover overlying and separate from said electrical cord housing and emitting light received therein, radially therefrom in a continuous array; and a light disposed at one of said end connectors, selectively emitting light outwardly therefrom and into said translucent cover of said electrical cord, when activated.

2. An illuminated electrical cord comprising:

a) an electric current carrying component extending the length of the cord;

b) an electrically insulating material surrounding the electric current carrying component the entire length of the cord;

c) a light transmissive portion associated with said electrically insulating material for providing illumination along the entire length of the cord;

d) a light emitting diode associated with said light transmissive portion and providing a light source to facilitate illumination from said light transmissive portion; and e) a switch for selectively powering said light emitting diode with current from said electric current carrying component when current is available therein and powering said light emitting diode with current from a DC power source separate from said electric current carrying component when current is not available in said electric current carrying component.

3. The illuminated electrical cord as set forth in claim 2, wherein:

a) said light transmissive portion includes a translucent sleeve surrounding said insulating material.

4. The illuminated electrical cord as set forth in claim 2, further comprising:

a) an electrical plug located at a first end of said cord, said plug being electrically connected to said electric current carrying component.

5. The illuminated electrical cord as set forth in claim 4, wherein:

a) said electrical plug includes a housing and said light emitting diode is located within said housing.

6. The illuminated electrical cord as set forth in claim 5, wherein:

a) said light emitting diode is positioned within said housing such that light is directed toward said light transmissive portion.

7. The illuminated electrical cord as set forth in claim 5, wherein:

a) said housing further includes a focusing lens located between said light emitting diode and said light transmissive portion for focusing the light produced by said light emitting diode and directing the focused light toward said light transmissive portion.

8. The illuminated electrical cord as set forth in claim 2, wherein:

a) said light transmissive portion is translucent.

9. A combination illuminated electrical outlet and electrical cord, comprising:

a) an electrical outlet forming an electrical receptacle for receiving a plug of an electrical cord;

b) said electrical outlet further including a light emitting diode;

c) said light emitting diode being positioned on said outlet for alignment with said electrical cord;

d) said electrical cord having a light transmissive portion for providing illumination along the entire length of the cord when said light transmissive portion is aligned with said light emitting diode positioned on said electrical outlet.

10. The combination illuminated electrical outlet and electrical cord, as set forth in claim 9, wherein:

a) said light transmissive portion includes a translucent sleeve surrounding said insulating material.

11. The combination illuminated electrical outlet and electrical cord as set forth in claim 9, wherein:

a) said electrical outlet further includes a transformer for reducing the voltage supplied to said light emitting diode.

12. The combination illuminated electrical outlet and electrical cord as set forth in claim 11, wherein:

a) said electrical outlet further includes a focusing lens for focusing the light produced by said light emitting diode and directing the focused light toward said light transmissive portion of said electrical cord.

13. The illuminated electrical supply line of claim 1, further comprising:

a) an electrical plug located at a first end of said cord, said plug being electrically connected to said electric current carrying component.

14. The illuminated electrical supply line as set forth in claim 1, wherein said electrical plug includes a housing and said light emitting diode is located within said housing.

15. The illuminated electrical supply line as set forth in claim 14, wherein said light emitting diode is positioned within said housing such that light is directed toward said translucent cover.

16. The illuminated electrical supply line as set forth in claim 1, wherein said translucent cover is transparent.

17. The illuminated electrical supply line as set forth in claim 1, further comprising:

a switch for selectively powering said light with current from said electric conductor when current is available therein and powering said light emitting diode with current from a dc power source separate from said electric conductor.

18. The illuminated electrical supply line as set forth in claim 1, wherein said selectively removable, translucent cover is applied longitudinally along and over the electrical cord housing.

19. The illuminated electrical supply line as set forth in claim 1, wherein said selectively removable, translucent cover is a striped sheet applied in a spiral pattern around and over the electrical cord housing.

20. The illuminated electrical supply line as set forth in claim 1, wherein said selectively removable, translucent cover is woven and is applied longitudinally along and over the electrical cord housing.

* * * * *